United States Patent [19]

Nakashima et al.

[11] Patent Number: 4,790,468

[45] Date of Patent: Dec. 13, 1988

[54] FLOATING TYPE WEB GUIDING DEVICE

[75] Inventors: Hiroshi Nakashima; Sanshiro Fukuhara, both of Kanagawa, Japan

[73] Assignee: Fuji Photo Film Co., Ltd., Kanagawa, Japan

[21] Appl. No.: 5,819

[22] Filed: Jan. 21, 1987

[30] Foreign Application Priority Data

Jan. 21, 1986 [JP] Japan ..... 61-8894

[51] Int. Cl.[4] ..... B65H 20/14; B65H 23/24

[52] U.S. Cl. ..... 226/97; 226/196

[58] Field of Search ..... 226/97, 197, 196; 34/156, 122

[56] References Cited

U.S. PATENT DOCUMENTS

| | | | |
|---|---|---|---|
| 862,330 | 8/1907 | Harris | 226/97 |
| 3,567,093 | 3/1971 | Johnson | 226/97 |
| 4,074,841 | 2/1978 | Kramer et al. | 226/97 |
| 4,300,714 | 11/1981 | Dahl et al. | 226/97 X |

FOREIGN PATENT DOCUMENTS

| | | | |
|---|---|---|---|
| 2455548 | 6/1975 | Fed. Rep. of Germany | 226/197 |
| 60-93056 | 5/1985 | Japan . | |

*Primary Examiner*—John Petrakes
*Assistant Examiner*—Lynn M. Schack
*Attorney, Agent, or Firm*—Sughrue, Mion, Zinn, Macpeak, and Seas

[57] ABSTRACT

In a floating type web guiding device in which a moving web is guided along a guide surface with fluid jetting holes while being floated above the guide surface, two groups of flow straightening boards are provided respectively at the web lead-in part and the web lead-out part of the guide surface in such a manner that the boards are arranged in parallel with the direction of movement of the web and perpendicular to the web surface, so that the web can be conveyed without rubbing the web surface.

6 Claims, 2 Drawing Sheets

FLOATING TYPE WEB GUIDING DEVICE

REFERENCE TO RELATED APPLICATIONS

This invention relates to U.S. Application Ser. No. 005,986, filed Jan. 21, 1987, entitled AIR JETTING BOX and; U.S. Application Ser. No. 059,985, filed June 9, 1987, entitled WEB POSITION DETECTING METHOD; and U.S. Application Ser. No. 074,817, filed July 17, 1987, entitled METHOD AND APPARATUS OF NON-CONTACT CONVEYANCE OF A WEB, all assigned to the common assignee.

BACKGROUND OF THE INVENTION

1. Field of the Invention

This invention relates to a floating type web guiding device which conveys a long belt-like material (hereinafter referred to as "a web"), while floating it above its guide surface. This device is used in the manufacture of photographic photosensitive materials such as photographic films and print paper, photomechanical process materials, magnetic recording materials such as magnetic recording tapes, or recording materials such as pressure-sensitive copying sheets or heat-sensitive copying sheets.

2. Background of the Invention

A floating type web guiding device is well known in the art in which a web is conveyed along a guide surface having fluid jetting holes or slits. The web is conveyed while being floatd above the guide surface. The guide surface is arcuate in section so that the direction of conveyance of the web is changed while the web is run along the curved guide surface.

In the floating type web guiding device, the web is stably floated above the guide surface in the case where the radius of the guide surface arcuate in section is large and the tension of the web is low. On the other hand, in the case where the radius of the guide surface is small and the tension of the web is high, in order to float the web above the guide surface it is necessary to increase the pressure of the fluid serving as cushion between the web and the guide surface. When the high pressure fluid between the web and the guide surface is discharged from between there at a web lead-in part or a web lead-out part of the guide surface through which the web is led into or out of the space over the guide surface, the web is greatly vibrated or fluttered. As a result, the web may be brought into contact with the guide surface.

In order to prevent the fluttering of the web, a device has been proposed by Japanese Patent Application (OPI) No. 93056/1985. In the conventional device, guide boards are extended in the direction of movement of the web and along the guide surface.

It is true that the device is effective in supressing the fluttering of the web. However, the device is still disadvantageous in that the venturi effect is produced between the web and the guide boards, so that the pressure of fluid between the web and the guide boards is decreased and accordingly the amount of floating of the web is reduced. Therefore, in the case where, for instance, a curled web is conveyed by the device, the web is liable to contact the guide boards, and the manufactured product may not have acceptable quality.

SUMMARY OF THE INVENTION

Accordingly, an object of this invention is to provide a floating type web guiding device in which, even when the device is miniaturized or the tension of a web to be conveyed by the device is high, the fluttering of the web is suppressed and the web can be smoothly conveyed without contacting guide means such as the guide surface and the guide boards.

Another object of the invention is to provide a fluid-floated web guiding device in which the fluttering is prevented for a web low in rigidity (such as a web small in thickness, held at high temperature, or having a low strength), and in which the web can be smoothly conveyed without contacting guide means such as the guide surface and the guide boards.

The foregoing objects of the invention have been achieved by the provision of a floating type web guiding device in which a moving web is conveyed along a guide surface having fluid jetting holes or slits while being floated above the guide surface. According to the invention, the device comprises two groups of flow straightening boards provided respectively at a web lead-in part and a web lead-out part of the guide surface in such a manner that each flow straightening board is in parallel with the direction of movement of the web and perpendicular to the surface of the web.

The nature, principle and utility of the invention will become more apparent from the following detailed description when read in conjunction with the accompanying drawings.

DETAILED DESCRIPTION OF THE PREFERRED EMBODIMENTS

Figure 1A:
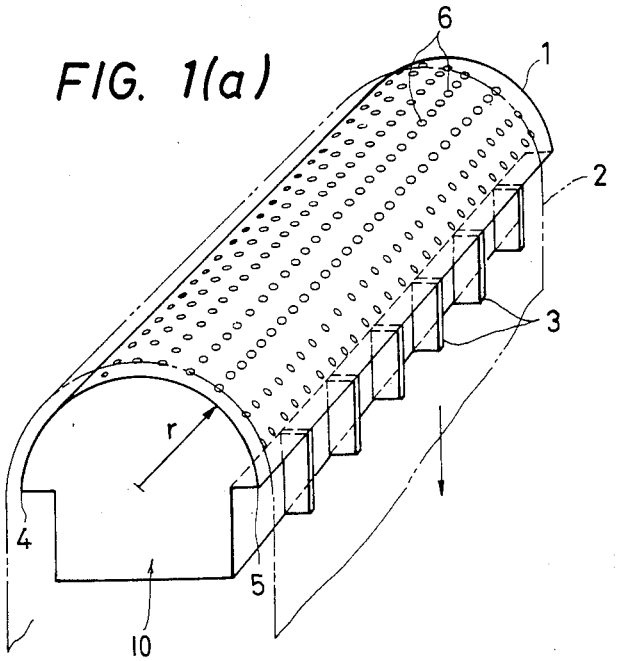
FIGS. 1(*a*) and 1(*b*) show a floating type web guiding device which is a first embodiment of this invention. More specifically, FIG. 1(*a*) is a perspective view of the floating type web conveying device, and FIG. 1(*b*) is a sectional view of the web conveying device.
Figure 1B:
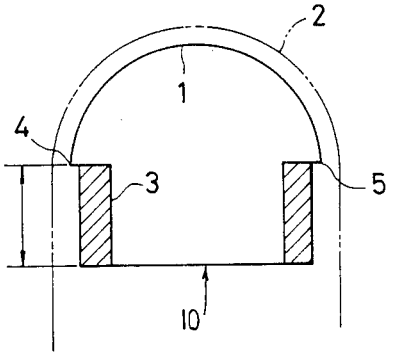

A floating type web conveying device, a first embodiment of this invention, as shown in FIGS. 1(*a*) and 1(*b*), comprises an air blowing box 10 with an upper, aperture cylindrical plate forming a guide surface 1 which has a number of fluid jetting holes 6 and is arcuate in section. In the web conveying device, a web 2 is conveyed in the direction of the arrow while floating above the guide surface 1 on jets of fluid from holes 6 and changes the direction of travel at the guide surface 1. The web conveying device further comprises two groups of laterally spaced, flat flow straightening boards 3 which are extended respectively from the web lead-in part 4 and the web lead-out part 5 of the guide surface 1 in such a manner that the boards 3 are in parallel with the direction of movement of the web 2 and perpendicular to the surface of the web 2.

Figure 2A:
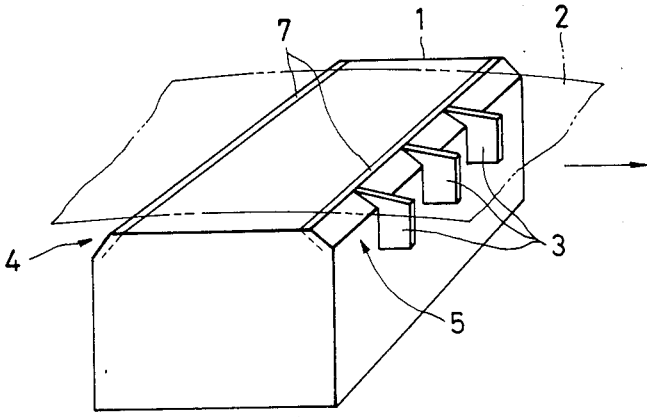
FIGS. 2(*a*) and 2(*b*) show a floating type web guiding device which is a second embodiment of the invention. More specifically, these figures are a perspective view and a sectional view of the web conveying device, respectively.
Figure 2B:
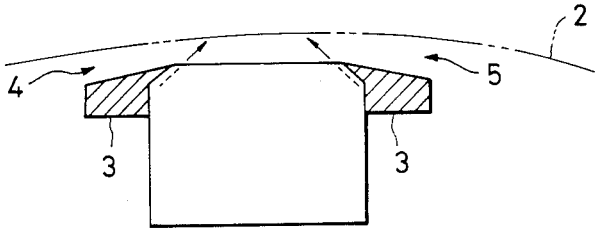

A second embodiment of the invention, a floating type web guiding device, is as shown in FIGS. 2(*a*) and 2(*b*). In the web guiding device, a web 2 is run along a guide surface 1 with fluid jetting slits 7 while floating above the guide surface 1. Two groups of flow straightening boards 3 are extended respectively from the web lead-in part 4 and the web lead-out part 5 of the guide surface 1 in such a manner that the boards 3 are in parallel with the direction of movement of the web 2 and perpendicular to the surface of the web 2. The upper surfaces of the flow straightening boards 3 slope downwards from the flat guide surface 1. Several of the web guiding devices shown in FIG. 2(*a*) and 2(*b*) are arrangd, for instance, as shown in FIG. 3 so that the web is guided in the form of wave.

The length of each flow straightening board 3 in the direction of movement of the web 2 and the height (or width) in the direction perpendicular to the web surface should be increased as much as possible in order to improve the flow straightening effect. It is desirable that the length in the direction of movement of the web is at least in a range of from 50 mm to 150 and the height (or width) in the direction perpendicular to the web is at least in a range of from 10 mm to 30 mm. The smaller the distance between the adjacent flow straightening boards 3, the higher is the flow straightening effect. However, it is practical that the flow straightening boards 3 are arranged at intervals of the order of 20 mm to 100 mm. It is effective both in reducing the floating of the web and in lowering the venturi effect to design the thickness of each flow straightening board in such a manner that the surface of the board in parallel with the web surface is as small as possible. Therefore, it is preferable that the flow straightening boards are small in thickness, for instance 1 mm to 2 mm. The material of the flow straightening boards should be such that the boards satisfy the above-described requirement of thickness and have sufficiently high mechanical strength. Therefore, the flow straightening boards may be made of a metal plate such as an iron plate, stainless steel plate or aluminum plate, or a plastic plate.

Since the flow straightening boards are provided as described above, the flow of gas at the web lead-in part and the web lead-out part of the guide surface can be satisfactorily straightened in parallel with the direction of movement of the web, and near the flow straightening boards, the vibration of the web can be suppressed while the web is kept sufficiently floated above.

Figure 3:
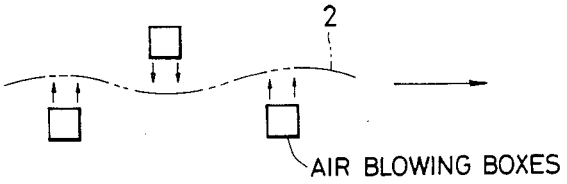
FIG. 3 is an explanatory diagram showing the arrangement of air blowing boxes in a floating type web guiding and drying device.

The technical concept of the invention is applicable to the air blowing boxes in a web guiding device in which the web is supported by an air flow so that it is conveyed while being floated in wavy form as shown in FIG. 3.

Examples of the webs handled by the web guiding device of the invention are webs of paper, plastic film, metal, resin-coated paper, and synthetic paper. The plastic film is made of, for instance, polyolefin such as polyethlene or polypropylene, vinyl copolymer such as polyvinyl acetate, polyvinyl chloride or polystyrene, polyamide such as 6,6-nylon or 6-nylon, polyester such as polyethylene terephthalate or polyethylene-2,6-naphthalate, or cellulose acetate such as polycarbonate, cellulose triacetate or cellulose diacetate. Typical example of the resin of the resin-coated paper are polyethlene and polyolefin. However, the resin is not always limited thereto. The metal web may also be an aluminum web.

In general, in a web guiding device of the above-described type, the pressurized fluid between the web and the guide surface is quickly discharged at the web lead-in part and the web lead-out part of the guide surface. In this operation, since the streams of fluids jetted from the number of fluid jetting holes are not always the same in direction, the streams of fluid collide with one another to vibrate the web. In this case, the web is greatly fluttered especially by the streams of fluid which flow in the direction of width of the web.

However, in the web guiding device of the invention, the flow straightening boards are provided at the web lead-in part and the web lead-out part of the guide surface in such a manner that the boards are in parallel with the direction of movement of the web and perpendicular to the web surface as was described before, and therefore the streams of fluid are in parallel with the direction of movement of the web, and the fluttering of the web can be suppressed.

In this operation, the web is steadily kept floated above the flow straightening boards, and the fluttering of the web is minimized. Thus, the web is never brought into contact with the guide surface.

SPECIFIC EXAMPLE

Under the conditions that, in FIG. 1, the guide surface 1 had a radius r of 200 mm and a polyethylene terephthalate film 2 having a thickness of 120 micrometers was conveyed with an amount of floating of 15 mm and a tension of 10 kg/1000 mm, the fluttering of the web 2 was measured with a laser displacement gage.

When the flow straightening boards were removed from the web guiding device, the amplitude of the fluttering was 16 to 20 mm. On the other hand, in an embodiment of the invention, the device is provided with a plurality of flow straightening boards having a length of 150 mm in the direction of movement of the web, a height (or width) of 15 mm in the direction perpendicular to the web surface and a thickness of 5 mm and arranged at intervals of 80 mm. In this case, the amplitude of the fluttering was as small as 5 to 8 mm.

As was described above, in the floating type web guiding device of the invention, the flow straightening boards for regulating the streams of fluid are extended from the web lead-in part and the web lead-out part of the guide surface, so that the web is conveyed while being steadily floated above the guide surface. That is, the fluttering of the web is suppressed. Thus, the web can be stably and smoothly conveyed over the web guiding device of to the invention.

When a thin web low in rigidity is to be conveyed, the employment of the floating type web guiding device according to the invention is especially effective in suppressing the fluttering of the web.

Furthermore, in the case also when the pressure of the fluid between the web and the guide surface is high, the fluttering of the web can be suppressed in the web guiding device of the invention. Therefore, the web guiding device can be miniaturized (the radius of the guide surface can be reduced), which contributes to a reduction of the manufacturing cost of the entire web conveying equipment. For the same reason, the web can be smoothly conveyed even under high tension.

What is claimed is:

1. In a floating type web guiding device comprising:

an air blowing box including a plate forming a guide surface having fluid jetting apertures therein for floating a web on jets of fluid issuing from said apertures above said surface, said web being moved in a direction across said surface; the improvement comprising:

two groups of multiple, fixed, laterally spaced, thin, flat flow straightening boards provided respetively at a web lead-in part and a web lead-out part of said guide surface, the multiple flat flow straightening boards of each group extending parallel to each other and extending parallel to said web moving direction and having thin edges facing said web and lying adjacent said web in such a manner that each flow straightening board is parallel with the direction of movement of said web and projects perpendicular to and away from the surface of said web to suppress fluttering of the web during movement over the floating type web guiding device.

2. A floating type web guiding device as claimed in claim 1, in which:

each of said flow straightening boards has a length in a range from 50 mm to 150 mm in the direction of movement of said web, and a height in a range from 10 mm to 30 mm in direction perpendicular to the surface of said web; and said flow straightening boards are laterally spaced at intervals perpendicular to said direction of movement of said web from 20 mm to 100 mm.

3. A floating type web guiding device as claimed in claim 2, in which:

each of said boards has a thickness in a range from 1 mm to 2 mm.

4. A floating type web guiding device as claimed in claim 1, in which said guide surface is substantially flat.

5. A floating type web guiding device as claimed in claim 4, in which said edges of said flow straightening boards are inclined to said flat guide surface.

6. A floating type web guiding device as claimed in claim 1, in which said guide surface is convexly curved alont said web movement direction.

* * * * *